US008497887B2

(12) United States Patent
Cho et al.

(10) Patent No.: US 8,497,887 B2
(45) Date of Patent: Jul. 30, 2013

(54) DISPLAY DRIVING UNIT AND METHOD FOR USING THE SAME

(75) Inventors: Sheng-Tien Cho, Miao-Li County (TW); Eddy Giing-Lii Chen, Miao-Li County (TW)

(73) Assignee: Chimei Innolux Corporation, Miao-Li County (TW)

( * ) Notice: Subject to any disclaimer, the term of this patent is extended or adjusted under 35 U.S.C. 154(b) by 664 days.

(21) Appl. No.: 12/795,813

(22) Filed: Jun. 8, 2010

(65) Prior Publication Data

US 2010/0321415 A1 Dec. 23, 2010

(51) Int. Cl.
*G09G 5/10* (2006.01)
*G09G 3/36* (2006.01)

(52) U.S. Cl.
USPC ..... 345/690; 345/89

(58) Field of Classification Search
USPC ..... 345/690, 89
See application file for complete search history.

(56) References Cited

U.S. PATENT DOCUMENTS

| | | | | |
|---|---|---|---|---|
| 6,683,595 | B2 | 1/2004 | Ikeda | |
| 7,061,504 | B1 * | 6/2006 | Glen | 345/600 |
| 2002/0003520 | A1 * | 1/2002 | Aoki | 345/87 |
| 2006/0038837 | A1 * | 2/2006 | Hong | 345/691 |
| 2008/0252668 | A1 * | 10/2008 | Chen | 345/690 |
| 2008/0309600 | A1 * | 12/2008 | Lee et al. | 345/89 |

FOREIGN PATENT DOCUMENTS

| | | | |
|---|---|---|---|
| CN | 101452681 | A | 6/2009 |
| CN | 101458907 | A | 6/2009 |

* cited by examiner

*Primary Examiner* — Alexander S Beck
*Assistant Examiner* — Joseph Pena
(74) *Attorney, Agent, or Firm* — WPAT, PC; Justin King

(57) ABSTRACT

A display driving unit used in a liquid crystal display (LCD) stores two γ curves. When the LCD displays images, the display driving unit determines the luminance of the image in a first sub-period for displaying the image according to the gray level of the image and the first γ curve, and determines the luminance of the image in a second sub-period for displaying the image according to the gray level of the image and the second γ curve. The LCD displays the image in the luminance determined according to the gray level of the image and the first γ curve in the first sub-period and displays the image in the luminance determined according to the gray level of the image and the second γ curve in the second sub-period.

12 Claims, 15 Drawing Sheets

DISPLAY DRIVING UNIT AND METHOD FOR USING THE SAME

BACKGROUND

1. Technical Field

The present disclosure relates to display technology, and particularly to a display driving unit providing decreased flicker of a liquid crystal display (LCD) and a method for using the same.

2. Description of Related Art

Hold-type display technology is widely used in LCD applications. Referring to FIG. 11, an LCD stores a γ curve γ2.2, which describes the functional relationship between the gray level of images displayed by the LCD and the luminance of each pixel of the LCD. When the LCD displays images, it regulates the luminance of each pixel thereof according to the gray level of the images corresponding to the pixel and γ2.2. For example, also referring to FIG. 12, a pixel of the LCD is used to respectively display its corresponding portions of a plurality of sequential images on a plurality of sequential display periods for example, T0-T1, T1-T2, T2-T3. On each display period, the luminance of the pixel is sequentially regulated according to the gray level of the images and γ2.2. However, commonly used hold-type display technology may generate blur. When the displayed images are changed for example, on T1/T2, each previous image is directly replaced by the subsequent image. If the luminance of some pixels is not regulated in a timely manner according to the gray level of the next image, the portions of the previous image corresponding to these pixels may temporarily remain and overlap the next image, generating blur.

Black insertion technology is widely used to overcome the above-detailed shortcoming. Also referring to FIG. 13, when an LCD sequentially displays a plurality of common images, the common images are respectively displayed on separate display periods for example, T0-T01, T1-T11, T2-T21. Any two adjacent display periods are separated by a black insertion period for example, T01-T1, T11-T2, T21-T3, and the LCD displays a complete black image in no luminance on each black insertion period. Each complete black image can prevent the previous common image from overlapping the subsequent common image, thereby preventing blur. However, since the complete black images have no luminance, they may decrease the average luminance of the LCD. Furthermore, the complete black images contrast clearly with other images. When the complete black images and the common images are alternately displayed by the LCD, the LCD may generate flicker.

Gray insertion technology is widely used to overcome the detailed shortcoming of black insertion technology. Also referring to FIG. 14, an LCD stores a first γ curve γ1 for describing the functional relationship between the gray level of common images displayed by the LCD and the luminance of each pixel of the LCD, and a second γ curve γ2 for describing the functional relationship between the gray level of gray insertion images displayed by the LCD and the luminance of each pixel of the LCD. The average of the luminance respectively determined according to γ1 and γ2 is set to approximately equivalent to the luminance determined according to the γ curve γ2.2, such that the average luminance of the LCD using gray insertion technology is similar to that of LCDs not using the gray insertion technology, thereby saving electric power and improving display quality. The first γ curve γ1 is above the γ curve γ2.2, and the second γ curve γ2 is below the γ curve γ2.2. Other than the luminance corresponding to the lowest gray level, that is the luminance of a complete white image, and the highest gray level, that is the luminance of a complete black image, of the LCD, the luminance corresponding to any gray level according to γ1 is higher than the luminance corresponding to any gray level according to γ2.2, and the luminance corresponding to any gray level according to γ2 is lower than the luminance corresponding to any gray level according to γ2.2.

Also referring to FIG. 15, when the LCD sequentially displays a plurality of images, each image is displayed in a display period for example, T0-T1, T1-T2, T2-T3. Each display period includes a previous common display sub-period for example, T0-T01, T1-T11, T2-T21, and a sequent gray insertion sub-period for example, T01-T1, T11-T2, T21-T3. In the common display sub-period, the luminance of each pixel of the LCD is regulated according to the gray level of the image and γ1, and thus the image is normally displayed in higher luminance, that is, displaying a common image. In the gray insertion sub-period, the luminance of each pixel of the LCD is regulated according to the gray level of the image and γ2, and thus the image is displayed in lower luminance, that is, as a gray insertion image. Until the common display sub-period of the subsequent display period comes, the gray insertion image is replaced by the subsequent common image. In this way, any two common images in higher luminance regulated according to γ1 are separated by a gray insertion image in lower luminance regulated according to γ2. Each gray insertion image can prevent the previous common image from overlapping the subsequent common image, thereby preventing blur. Furthermore, the gray insertion images contrast with the common images less clearly than complete black images. Compared with use of black insertion technology, an LCD using the gray insertion technology exhibits decreased flicker and enhanced average luminance.

However, in the gray insertion technology described, γ1 and γ2 are respectively positioned above and below γ2.2. In many gray levels, the luminance corresponding to a gray level according to γ1 may be higher than the luminance corresponding to the same gray level according to γ2. Thus, the common images (in higher luminance regulated according to γ1) may still contrast clearly with the gray insertion images (in lower luminance regulated according to γ2) and the gray insertion technology only refers to one γ curve in one sub-period. Despite improving on black insertion technology, the gray insertion technology may still generate flicker.

Therefore, there is room for improvement within the art.

SUMMARY

According to one embodiment of the present disclosure, a display driving unit used in an LCD having a display panel is provided. The display driving unit includes a scan driving circuit connected to the display panel, a data driving circuit connected to the display panel, and a gray insertion processing unit including a processor, a register, a first storage unit, and a second storage unit. The first storage unit stores a first γ curve, the second storage unit stores a second γ curve, and both the first storage unit and the second storage unit store a standard γ curve. The first γ curve and the second γ curve intersect and respectively include at least one high luminance segment corresponding to luminance higher than luminance corresponding to the portion of the standard γ curve in the gray level range of the high luminance segment and at least one low luminance segment corresponding to luminance lower than luminance corresponding to the portion of the standard γ curve in the gray level range of the low luminance segment. The high luminance segments of one of the first γ curve and the second γ curve and the low luminance segments of another of the first γ curve and the second γ curve correspond to same gray level ranges. The register stores data of each image displayed by the liquid crystal display, the processor detects the gray level of the image, determines the luminance of the image in a first sub-period for displaying the image according to the gray level of the image and the first γ curve, and determines the luminance of the image in a second sub-period for displaying the image according to the gray level of the image and the second γ curve. The data driving circuit cooperates with the scan driving circuit to sequentially display the image in the luminance determined according to the gray level of the image and the first γ curve in the first sub-period and display the image in the luminance determined according to the gray level of the image and the second γ curve in the second sub-period.

According to one embodiment of the present disclosure, a method for using a display driving unit in an LCD to drive the LCD to display an image is provided. The method includes these steps: storing a standard γ curve, a first γ curve and a second γ curve in the display driving unit, the first γ curve and the second γ curve intersecting and respectively including at least one high luminance segment corresponding to luminance higher than luminance corresponding to the portion of the standard γ curve in the gray level range of the high luminance segment and at least one low luminance segment corresponding to luminance lower than luminance corresponding to the portion of the standard γ curve in the gray level range of the low luminance segment; the high luminance segments of one of the first γ curve and the second γ curve and the low luminance segments of another of the first γ curve and the second γ curve corresponding to same gray level ranges; inputting data of the image to the display driving unit; using the display driving unit to detect the gray level of the image; using the display driving unit to determine the luminance of the image in a first sub-period for displaying the image according to the first γ curve, and determine the luminance of the image in a second sub-period for displaying the image according to the second γ curve; and using the display driving unit to drive the liquid crystal display to sequentially display the image in the luminance determined according to the gray level of the image and the first γ curve in the first sub-period and display the image in the luminance determined according to the gray level of the image and the second γ curve in the second sub-period.

Other advantages and novel features will become more apparent from the following detailed description when taken in conjunction with the accompanying drawings.

BRIEF DESCRIPTION OF THE DRAWINGS

Many aspects of the present display driving unit and method for using the same can be better understood with reference to the following drawings. The components in the various drawings are not necessarily drawn to level, the emphasis instead placed upon clearly illustrating the principles of the present display driving unit and method for using the same. Moreover, in the drawings, like reference numerals designate corresponding parts throughout the figures.

DETAILED DESCRIPTION

Figure 1:
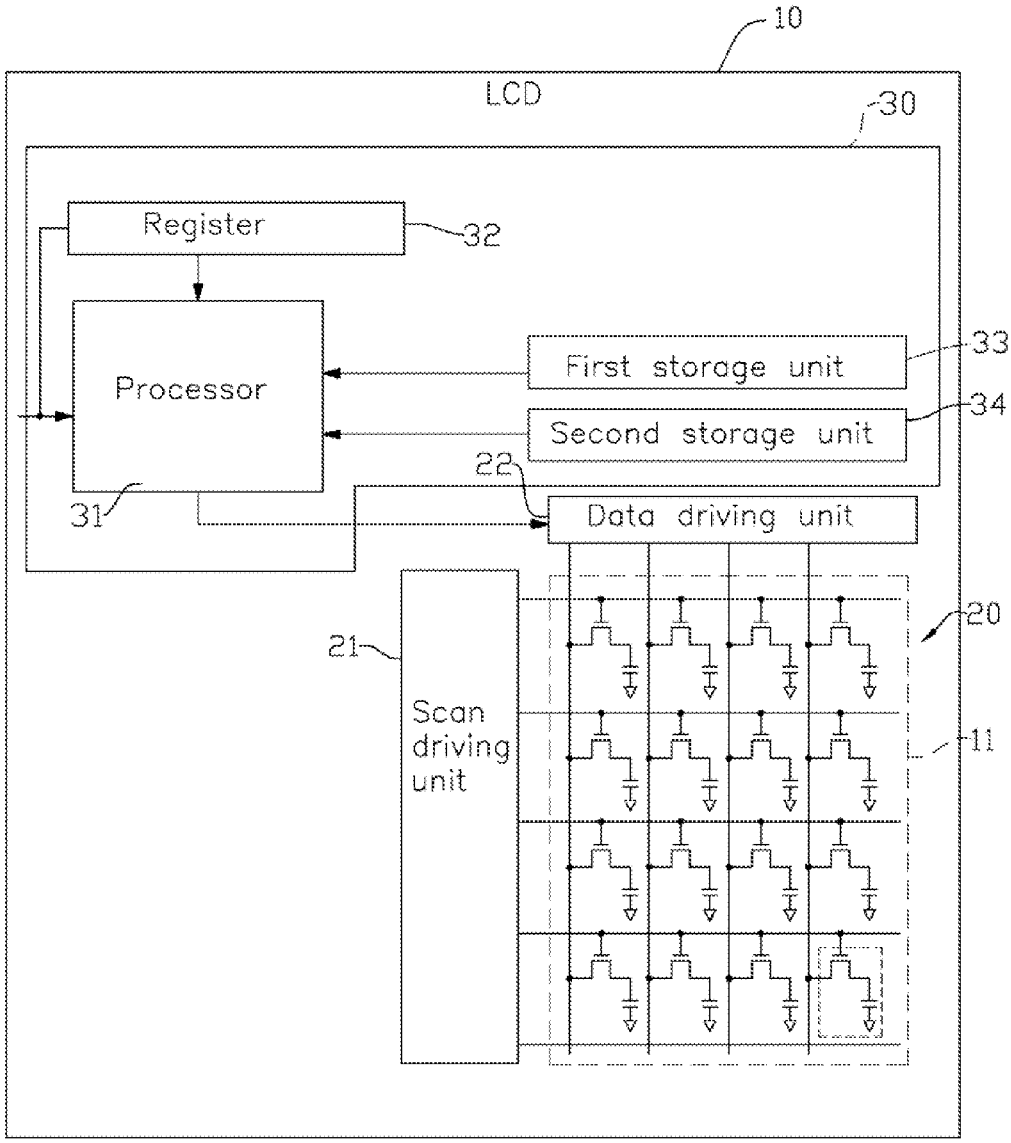
FIG. 1 is a block diagram of a display driving unit used in an LCD, according to an exemplary embodiment.

FIG. 1 shows a display driving unit 20, according to an exemplary embodiment, used in an LCD 10. The display driving unit 20 includes a scan driving circuit 21, a data driving circuit 22, and a gray insertion processing unit 30. The scan driving circuit 21 and the data driving circuit 22 are both connected to a display panel 11 of the LCD 10. The gray insertion processing unit 30 is connected to the data driving circuit 22. In use, the luminance of displayed images is determined by the gray insertion processing unit 30. The data driving circuit 22 cooperates with the scan driving circuit 21 to drive the LCD 10 to display images on the display panel 11 according to the luminance determined by the gray insertion processing unit 30.

The gray insertion processing unit 30 includes a processor 31, a register 32, a first storage unit 33, and a second storage unit 34. The register 32, the first storage unit 33, and the second storage unit 34 are all connected to the processor 31. The processor 31 is connected to the data driving circuit 23. Alternatively, the register 32 may be integrated into the processor 31.

Figure 2:
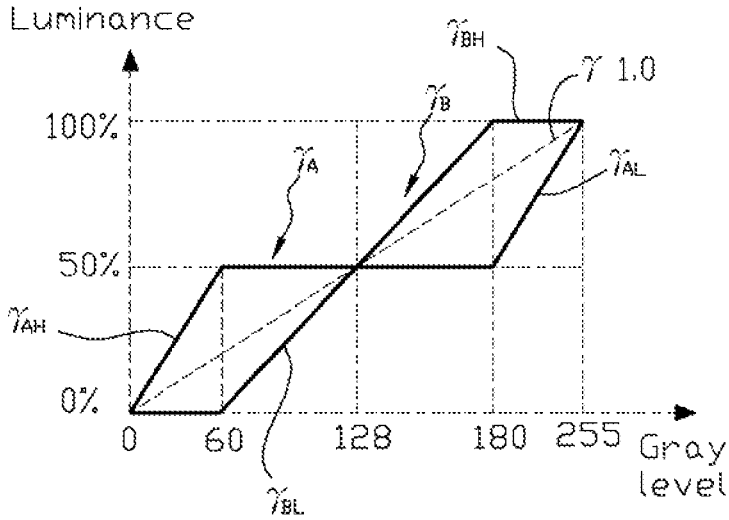
FIG. 2 is a diagram of two γ curves according to a first embodiment of the present disclosure.

As in most commonly used LCDs, the LCD 10 has 256 gray levels, that is gray level 0-255, and the luminance of each pixel of the LCD 10 must be regulated according to different gray levels. Also referring to FIG. 2, a standard γ curve γ 1.0, which describes the functional relationship between the luminance of each pixel of the LCD 10 and the gray level of the images displayed by the LCD 10, is stored in both the first storage unit 33 and the second storage unit 34. The standard γ curve γ 1.0 is a straight line segment connecting the point having coordinates corresponding to the gray level 0 and 0% of the highest luminance to the point comprising coordinates corresponding to the gray level 255 and 100% of the highest luminance. According to γ 1.0, the luminance gradually increases with the gray level, and the functional relationship between the luminance and the gray level is directly proportional. Further, a first γ curve $\gamma_A$ is stored in the first storage unit 33, and a second γ curve $\gamma_B$ is stored in the second storage unit 34. The average of the luminance respectively determined according to $\gamma_A$ and $\gamma_B$ is set to be approximately equivalent to the luminance determined according to γ1.0, such that the average luminance of the LCD 10 is similar to that of a commonly used LCD, thereby saving electric power and improving display quality.

The first γ curve $\gamma_A$ is set to intersect the standard γ curve γ 1.0 at a point having coordinates corresponding to the gray level 128 and 50% of the highest luminance, that is the midpoint of γ 1.0. The first γ curve $\gamma_A$ is divided into a first high luminance segment $\gamma_{AH}$ and a first low luminance segment $\gamma_{AL}$ by the intersection of $\gamma_A$ and γ 1.0, that is the point having coordinates corresponding to the gray level 128 and 50% of the highest luminance. The first high luminance segment $\gamma_{AH}$ is at the left of the intersection of $\gamma_A$ and γ 1.0, that is, in the range corresponding to gray levels 0-128. Other than the luminance corresponding to the gray level 0 and the gray level 128, the luminance corresponding to any gray level according to $\gamma_{AH}$ is higher than the luminance corresponding to any gray level according to γ 1.0. The first low luminance segment $\gamma_{AL}$ is at the right of the intersection of $\gamma_A$ and γ 1.0, that is, in the range corresponding to gray levels 128-255. Other than the luminance corresponding to the gray level 128 and the gray level 255, the luminance corresponding to any gray level according to $\gamma_{AL}$ is lower than the luminance corresponding to any gray level according to γ 1.0.

The first high luminance segment $\gamma_{AH}$ includes a first ascending portion in the range of gray levels 0-60 and a first level portion in the range of gray levels 60-128. The first ascending portion is a straight line segment connecting the point having coordinates corresponding to the gray level 0 and 0% of the highest luminance to the point having coordinates corresponding to the gray level 60 and 50% of the highest luminance The first level portion is a level line segment connecting the point having coordinates corresponding to the gray level 60 and 50% of the highest luminance to the point having coordinates corresponding to the gray level 128 and 50% of the highest luminance. Therefore, in the range of gray levels 0-60, the luminance gradually increases with the gray level. In the range of gray levels 60-128, the luminance is an invariable, that is, 50% of the highest luminance.

The first low luminance segment $\gamma_{AL}$ includes a second level portion in the range of gray levels 128-180 and a second ascending portion in the range of gray levels 180-255. The second level portion is a level line segment connecting the point having coordinates corresponding to the gray level 128 and 50% of the highest luminance to the point having coordinates corresponding to the gray level 180 and 50% of the highest luminance. The second ascending portion is a straight line segment connecting the point having coordinates corresponding to the gray level 180 and 50% of the highest luminance to the point having coordinates corresponding to the gray level 255 and 100% of the highest luminance Therefore, in the range of gray levels 128-180, the luminance is an invariable, that is, 50% of the highest luminance. In the range of gray levels 180-255, the luminance gradually increases with the gray level.

The second γ curve $\gamma_B$ is also set to intersect the standard γ curve γ 1.0 at the point having coordinates corresponding to the gray level 128 and 50% of the highest luminance, that is the midpoint of γ 1.0. The second γ curve $\gamma_B$ is divided into a second high luminance segment $\gamma_{BH}$ and a second low luminance segment $\gamma_{BL}$ by the intersection of $\gamma_B$ and γ 1.0, that is the point having coordinates corresponding to the gray level 128 and 50% of the highest luminance. The second high luminance segment $\gamma_{BH}$ is at the right of the intersection of $\gamma_B$ and γ 1.0, that is, in the range corresponding to gray levels 128-255. Other than the luminance corresponding to the gray level 128 and the gray level 255, the luminance corresponding to any gray level according to $\gamma_{BH}$ is higher than the luminance corresponding to any gray level according to γ 1.0. The second low luminance segment $\gamma_{BL}$ is at the left of the intersection of $\gamma_B$ and γ 1.0, that is, in the range corresponding to gray levels 0-128. Other than the luminance corresponding to the gray level 0 and the gray level 128, the luminance corresponding to any gray level according to $\gamma_{BL}$ is lower than the luminance corresponding to any gray level according to γ 1.0. Thus, the γ curve $\gamma_A$ and $\gamma_B$ intersect and at one point of the standard γ curve.

The second low luminance segment $\gamma_{BL}$ includes a third level portion in the range of gray levels 0-60 and a third ascending portion in the range of gray levels 60-128. The third level portion is a level line segment connecting the point having coordinates corresponding to the gray level 0 and 0% of the highest luminance to the point having coordinates corresponding to the gray level 60 and 0% of the highest luminance. The third ascending portion is a straight line segment connecting the point having coordinates corresponding to the gray level 60 and 0% of the highest luminance to the point having coordinates corresponding to the gray level 128 and 50% of the highest luminance. Therefore, in the range of gray levels 0-60, the luminance is an invariable, that is, 0% of the highest luminance. In the range of gray levels 60-128, the luminance gradually increases with the gray level.

The second high luminance segment $\gamma_{BH}$ includes a fourth ascending portion in the range of gray levels 128-180 and a fourth level portion in the range of gray levels 180-255. The fourth ascending portion is a straight line segment connecting the point having coordinates corresponding to the gray level 128 and 50% of the highest luminance to the point having coordinates corresponding to the gray level 180 and 100% of the highest luminance. The fourth level portion is a level line segment connecting the point having coordinates corresponding to the gray level 180 and 100% of the highest luminance to the point having coordinates corresponding to the gray level 255 and 100% of the highest luminance. Therefore, in the range of gray levels 128-180, the luminance gradually increases with the gray level. In the range of gray levels 180-255, the luminance is an invariable, that is, 100% of the highest luminance.

When the LCD 10 is used to display images, the luminance of each pixel of the LCD 10 is alternately regulated according to the gray level of the displayed images and $\gamma_A$, $\gamma_B$. Particularly, each image is displayed in a display period, which includes a previous first sub-period and a sequent second sub-period. In the first sub-period, the luminance of each pixel is regulated according to the gray level of the image and $\gamma_A$. In the second sub-period, the luminance of each pixel is regulated according to the gray level of the image and $\gamma_B$.

Figure 3:
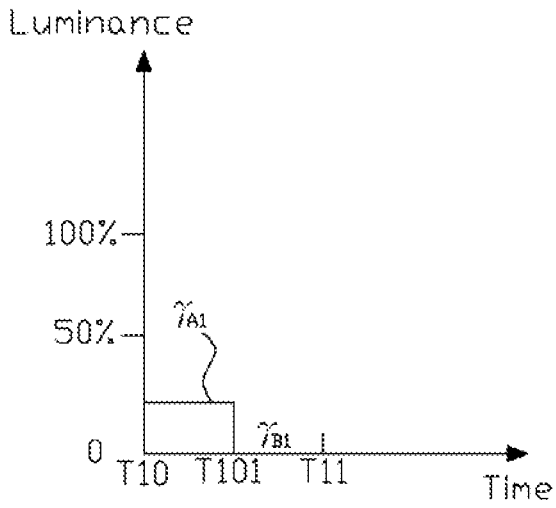
FIG. 3 is a diagram of the luminance of a pixel of the LCD using the display driving unit shown in FIG. 1 and displaying its corresponding portion of an image in a low gray level.

Also referring to FIG. 3, when the LCD 10 displays an image in a relatively low gray level for example, in a range of gray levels 0-60, the luminance of each pixel of the LCD 10 is first regulated according to the gray level of the image and the first ascending portion of the first high luminance segment $\gamma_{AH}$ in a first sub-period (T10-T101). Thus, the LCD 10 displays the image in luminance lower than 50% of the highest luminance of the LCD 10 and gradually increasing with the gray level of the image in the first sub-period, that is displaying a common image. Afterwards, the luminance of each pixel is regulated according to the gray level of the image and the third level portion of the second low luminance segment $\gamma_{BL}$ in a sequent second sub-period (T101-T11). Thus, the LCD 10 displays the image in no luminance, that is displaying a complete black image in the second sub-period. When the LCD 10 sequentially displays a plurality of images, the complete black images prevent the common image from generating blur. Since the luminance of the common images is relatively low (lower than 50% of the highest luminance of the LCD 10), the complete black images do not contrast clearly with the common images, which can reduce flicker.

Figure 4:
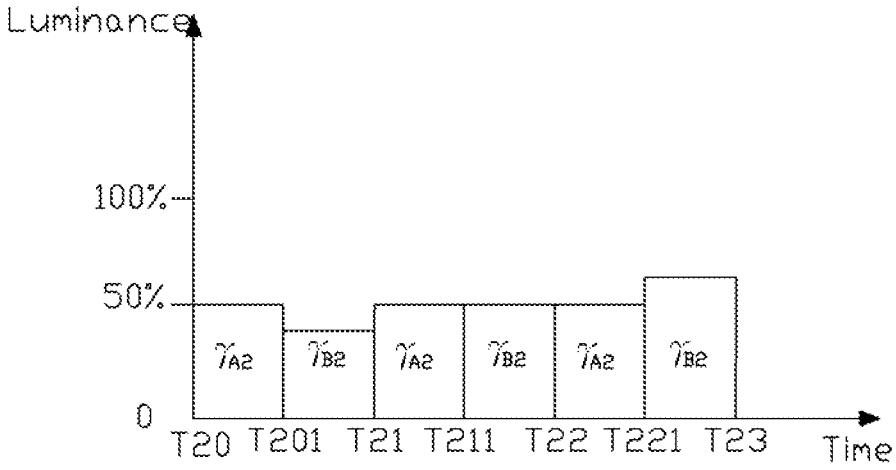
FIG. 4 is a diagram of the luminance of a pixel of the LCD using the display driving unit shown in FIG. 1 and sequentially displaying its corresponding portion of a plurality of images in medium gray levels.

Also referring to FIG. 4, when the LCD 10 displays an image in a medium gray level for example, in a range of gray levels 60-180, in a first sub-period for example, T20-T201, T21-T211, T22-T221, the luminance of each pixel of the LCD 10 is regulated according to the gray level of the image and the first level portion of the first high luminance segment $\gamma_{AH}$ when the gray level of the image is between 60-128, and regulated according to the gray level of the image and the second level portion of the first low luminance segment $\gamma_{AL}$ when the gray level of the image is between 128-180. According to either the first level portion of the first high luminance segment $\gamma_{AH}$ or the second level portion of the first low luminance segment $\gamma_{AL}$, the LCD 10 displays the image in an invariable luminance, that is, 50% of the highest luminance of the LCD 10 in the first sub-period, that is displaying a gray insertion image. Afterwards, in a sequent second sub-period for example, T201-T21, T211-T22, T221-T23, the luminance of each pixel is regulated according to the gray level of the image and the third ascending portion of the second low luminance segment $\gamma_{BL}$ when the gray level of the image is between 60-128, and regulated according to the gray level of the image and the fourth ascending portion of the second high luminance segment $\gamma_{BH}$ when the gray level of the image is between 128-180. Thus, the LCD 10 displays the image in luminance gradually increasing with the gray level of the image, that is displaying a common image) in the second sub-period. When the LCD 10 sequentially displays a plurality of images, the gray insertion images prevent the common image from generating blur.

When the LCD 10 displays images in medium gray levels for example, in a range of gray levels 60-180) according to the method described, the luminance of the common images may be lower than the luminance of the gray insertion images for example, the common image displayed in the first sub-period T201-T21, in a gray level between 0-60), equal to the luminance of the gray insertion images for example, the common image displayed in the first sub-period T211-T22, in the gray level 128, or higher than the luminance of the gray insertion images for example, the common image displayed in the first sub-period T211-T23, in a gray level between 128-180. However, since the common images are in medium gray levels, they do not contrast clearly with the gray insertion images in a medium luminance, that is 50% of the highest luminance, and flicker is minimized.

Figure 5:
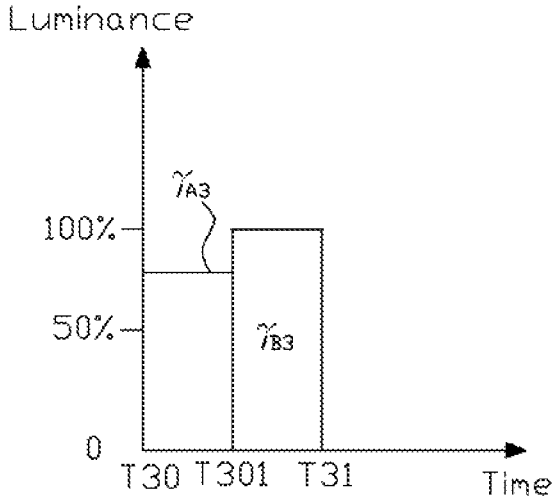
FIG. 5 is a diagram of the luminance of a pixel of the LCD using the display driving unit shown in FIG. 1 and displaying its corresponding portion of an image in a high gray level.

Also referring to FIG. 5, when the LCD 10 displays an image in a relatively high gray level for example, in a range of gray levels 180-255, the luminance of each pixel of the LCD 10 is first regulated according to the gray level of the image and the second ascending portion of the first low luminance segment $\gamma_{AL}$ in a first sub-period (T30-T301). Thus, the LCD 10 displays the image in luminance higher than 50% of the highest luminance of the LCD 10 and gradually increasing with the gray level of the image in the first sub-period, that is displaying a common image. Afterwards, the luminance of each pixel is regulated according to the gray level of the image and the fourth level portion of the second low luminance segment $\gamma_{BL}$ in a sequent second sub-period (T301-T31). Thus, the LCD 10 displays the image in the highest luminance, that is displaying a complete white image, in the second sub-period. When the LCD 10 sequentially displays a plurality of images, the complete white images prevent the common image from generating blur. Since the luminance of the common images is relatively high (higher than 50% of the highest luminance of the LCD 10), the complete white images do not contrast clearly with the common images, and flicker is minimized.

As shown, the high luminance segments of one of $\gamma_A$ and $\gamma_B$ and the low luminance segments of another of $\gamma_A$ and $\gamma_B$ correspond to same gray level ranges. Particularly, the first high luminance segment $\gamma_{AH}$ and the second low luminance $\gamma_{BL}$ both correspond to gray levels 0-128, and the average of the luminance respectively determined according to $\gamma_{AH}$ and $\gamma_{BL}$ is approximately equivalent to the luminance determined according to $\gamma$1.0 in gray levels 0-128. The second high luminance segment $\gamma_{BH}$ and the first low luminance $\gamma_{AL}$ both correspond to gray levels 128-256, and the average of the luminance respectively determined according to $\gamma_{AL}$ and $\gamma_{BH}$ is approximately equivalent to the luminance determined according to $\gamma$1.0 in gray levels 128-256. Thus, the difference between the luminance respectively determined according to $\gamma_A$ and $\gamma_B$ is decreased.

Figure 6:
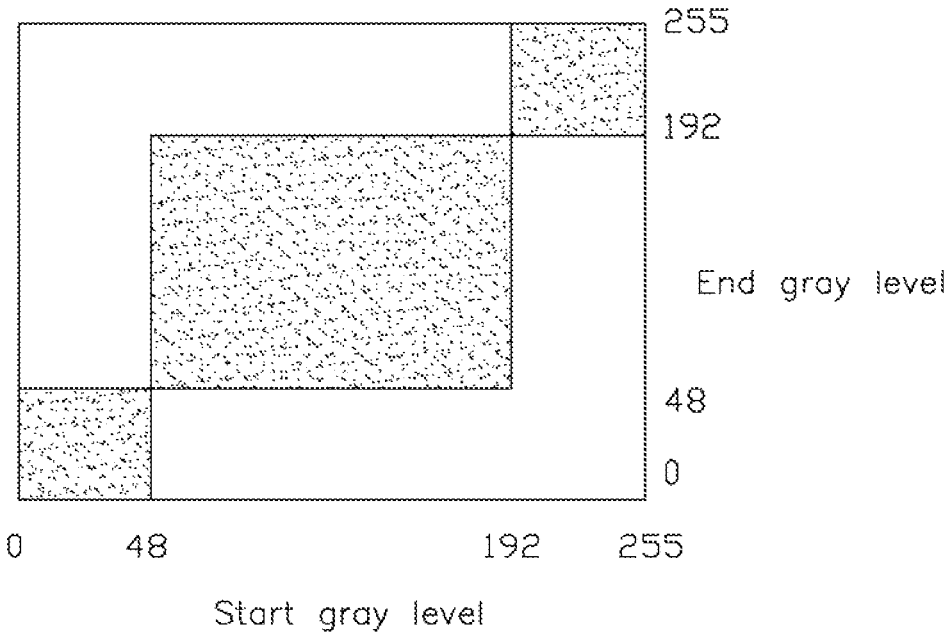
FIG. 6 is a diagram of a moving picture response time (MPRT) of the LCD using the display driving unit shown in FIG. 1.

Also referring to FIG. 6, in trials, the moving picture response time (MPRT) of the LCD 10 is measured in a time-integrating method. As shown in FIG. 6, in the labeled gray level ranges including relatively low gray level ranges of (start gray levels 0-48)*(end gray levels 0-48), medium gray level ranges of (start gray levels 48-192)*(end gray levels 48-192), and relatively high gray level ranges of (start gray levels 192-255)*(end gray levels 192-255), the blur of the LCD 10 can be effectively prevented.

Figure 7:
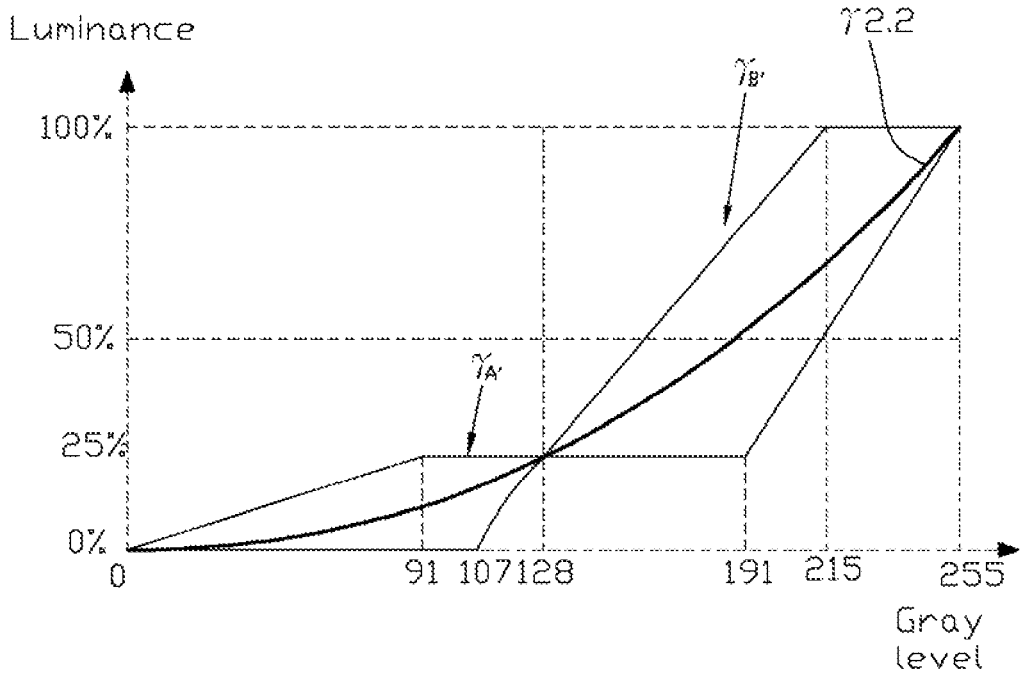
FIG. 7 is a diagram of two γ curves according to a second embodiment of the present disclosure.

The gray insert driving circuit 20 can also regulate the luminance of each pixel of the LCD 10 according to other $\gamma$ curves. Also referring to FIG. 7, the standard $\gamma$ curve $\gamma$1.0 is replaced by another standard $\gamma$ curve $\gamma$2.2, which is a gradually ascending parabola. The two $\gamma$ curves $\gamma_A$, $\gamma_B$ used as references to regulate the luminance of each pixel of the LCD 10 are respectively replaced by two new $\gamma$ curves $\gamma_A'$ and $\gamma_B'$. The average of the luminance respectively determined according to $\gamma_A'$ and $\gamma_B'$ is set to be approximately equivalent to the luminance determined according to $\gamma$2.2. The shapes of $\gamma_A'$ and $\gamma_B'$ are similar to those of $\gamma_A$ and $\gamma_B$, except that the gray level ranges corresponding to the ascending portions and level portions of $\gamma_{A1}$ and $\gamma_{B1}$ are different from the gray level ranges corresponding to the ascending portions and level portions of $\gamma_A$ and $\gamma_B$. Accordingly, when the luminance of each pixel of the LCD 10 is regulated according to $\gamma_A'$ in the first sub-periods and according to $\gamma_B'$ in the second sub-periods, the image gray level ranges corresponding to black insertion, gray insertion, and white insertion operations are all changed. As shown in FIG. 7, according to $\gamma_A'$ and $\gamma_B'$, the image gray level ranges corresponding to black insertion, gray insertion, and white insertion operations are respectively gray levels 0-107, 91-191, and 215-255.

Figure 8:
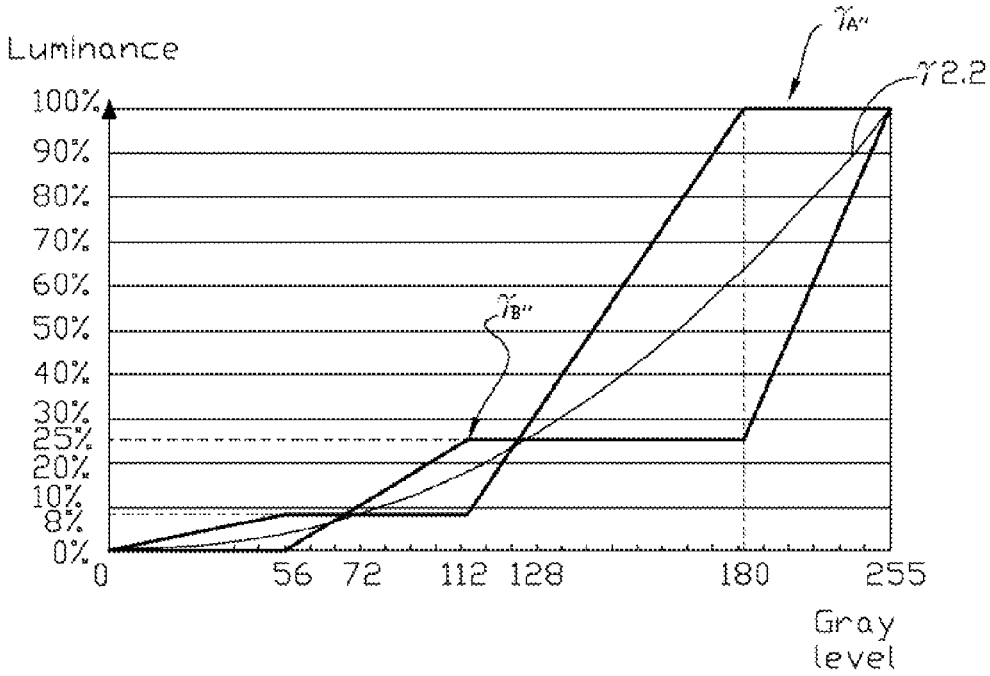
FIG. 8 is a diagram of a two γ curves according to a third embodiment of the present disclosure.

Also referring to FIG. 8, the two $\gamma$ curves $\gamma_A$ and $\gamma_B$ can be further respectively replaced by other two new $\gamma$ curves $\gamma_A''$ and $\gamma_B''$. The average of the luminance respectively determined according to of $\gamma_A''$ and $\gamma_B''$ is also set to be approximately equivalent to the luminance determined according to $\gamma$2.2. Each of the $\gamma$ curves $\gamma_A''$ and $\gamma_B''$ has two ascending portions and two level portions. Particularly, the $\gamma$ curve $\gamma_A''$ ascends in ranges corresponding to gray levels 0-56 and 112-180, and levels in ranges corresponding to gray levels 56-112 and 180-255. The two level portions of $\gamma_A''$ respectively correspond to 8% of the highest luminance and 100% of the highest luminance. The γ curve $\gamma_B$" levels in ranges corresponding to gray levels 0-56 and 112-180, and ascends in ranges corresponding to gray levels 56-112 and 180-255. The two level portions of $\gamma_B$" respectively correspond to no luminance and 25% of the highest luminance. Thus, the γ curves $\gamma_A$" and $\gamma_B$" intersect at two intersections, which are respectively positioned at the point having coordinates corresponding to the gray level 72 and 8% of the highest luminance, and the point having coordinates corresponding to the gray level 128 and 25% of the highest luminance. Therefore, $\gamma_A$" can be divided into two high luminance segments (in the range of gray levels 0-56 and 128-255) and a low luminance segment (in the range of gray levels 56-128) positioned between two high luminance segments, and $\gamma_B$" can be divided into two low luminance segments (in the range of gray levels 0-56 and 128-255) and a high luminance segment (in the range of gray levels 56-128) positioned between low high luminance segments.

According to the shape of $\gamma_A$" and $\gamma_B$", when the luminance of each pixel of the LCD 10 is regulated according to $\gamma_A$" in the first sub-periods and according to $\gamma_B$" in the second sub-periods, black insertion operations are presented in the range of the gray levels 0-56, that is the first level portion of $\gamma_B$"; gray insertion operations in relatively lower luminance, that is 8% of the highest luminance are presented in the range of gray levels 56-112, that is the first level portion of $\gamma_A$"; gray insertion operations in relatively higher luminance, that is 25% of the highest luminance are presented in the range of gray levels 112-180, that is the second level portion of $\gamma_B$"; and white insertion operations are presented in the range of the gray levels 180-255, that is the second level portion of $\gamma_A$".

In the above-detailed LCD 10, the display driving unit 20 stores two γ curves intersecting at one or more intersections. The LCD 10 displays each image in a display period including two sub-periods. When an image is displayed in a display period, it is first displayed in luminance regulated according to one γ curve in the first sub-period, and is then displayed in different luminance regulated according to another γ curve in the second sub-period. When the LCD 10 displays an image in a predetermined relatively low gray level, the image displayed in one sub-period serves as a common image, and the image displayed in another sub-period serves as a black insertion image. When the LCD 10 displays an image in a predetermined medium gray level, the image displayed in one sub-period serves as a common image, and the image displayed in another sub-period serves as a gray insertion image. Further, as shown in FIG. 8, the gray insertion images corresponding to images in different gray levels can be in different luminance. When the LCD 10 displays an image in a predetermined high gray level, the image displayed in one sub-period serves as a common image, and the image displayed in another sub-period serves as a black insertion image. When the LCD 10 sequentially displays a plurality of images, the black/gray/white insertion images prevent the common image from generating blur.

Additionally, since the two γ curves intersect, in most gray levels, the luminance corresponding to a gray level according to one γ curve and the luminance corresponding to the same gray level according to the other γ curve are not evidently different. Therefore, the common images in luminance regulated according to one γ curve do not contrast clearly with the black/gray/white insertion images in luminance regulated according to the other γ curve for example, as above detailed about FIGS. 2-5, paragraphs [0034]-[0037], and thus flickers can be prevented.

Figure 9:
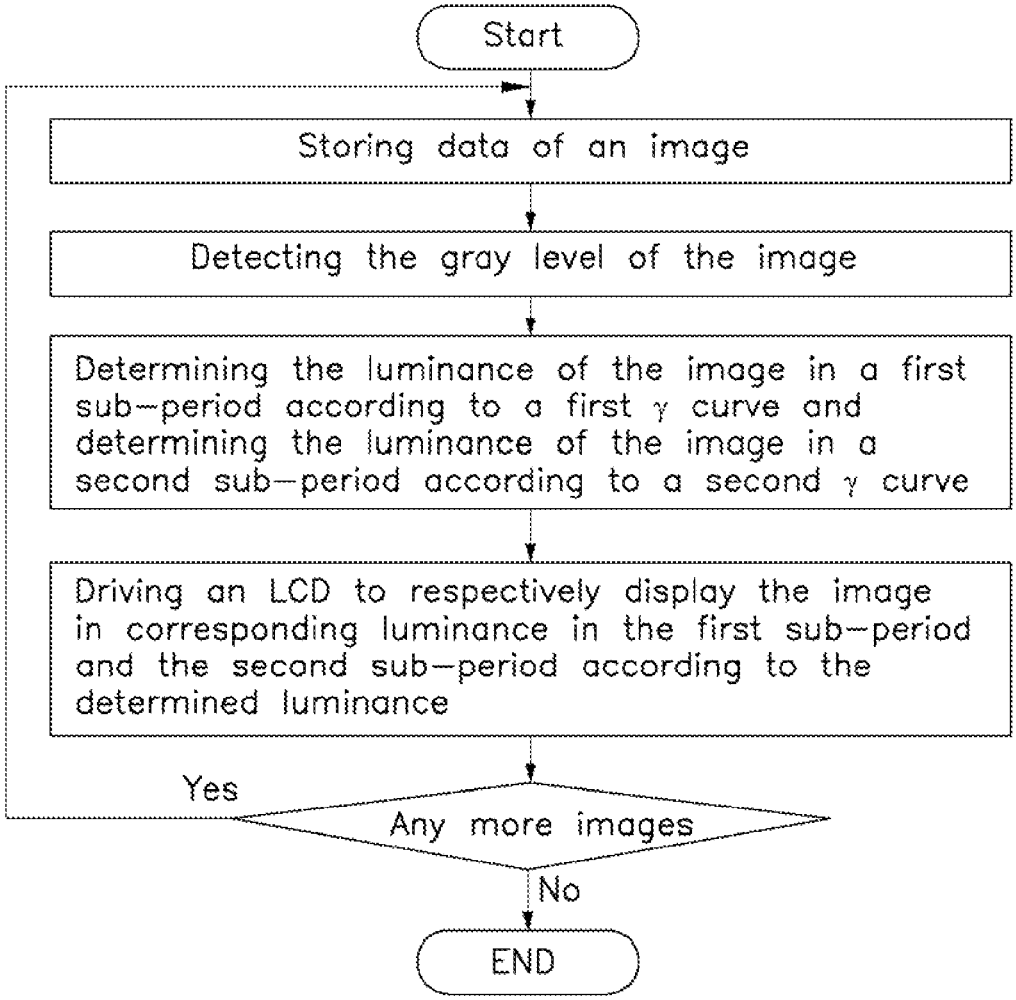
FIG. 9 is a flowchart of a gray insertion method according to a first embodiment.

Also referring to FIG. 9, a method for using the display driving unit 20 in the LCD 10 to drive the LCD 10 to display images, according to a first exemplary embodiment, is provided. The method includes these steps as follows. First, data of an image is input to the register 32 and temporarily stored in the register 32. Second, the stored data is transmitted to the processor 31, and the processor 31 detects the gray level of the image. Third, the processor 31 determines the luminance of the image in the first sub-period of the display period for displaying the image according to the first γ curve $\gamma_A$ stored in the first storage unit 33, and determines the luminance of the image in the second sub-period of the display period for displaying the image according to the second γ curve $\gamma_B$ stored in the second storage unit 34. Thus, the image data is input to the data driving circuit 22. The data driving circuit 22 cooperates with the scan driving circuit 21 to drive the LCD 10 to respectively display the image on the display panel 11 in corresponding luminance in the first sub-period and the second sub-period according to the luminance determined by the processor 31. When the subsequent image is to be displayed, the data of the new image is stored in the register 32 and replaces the data of the previous image. Thus, the described steps can be repeated to display the next image.

Figure 10:
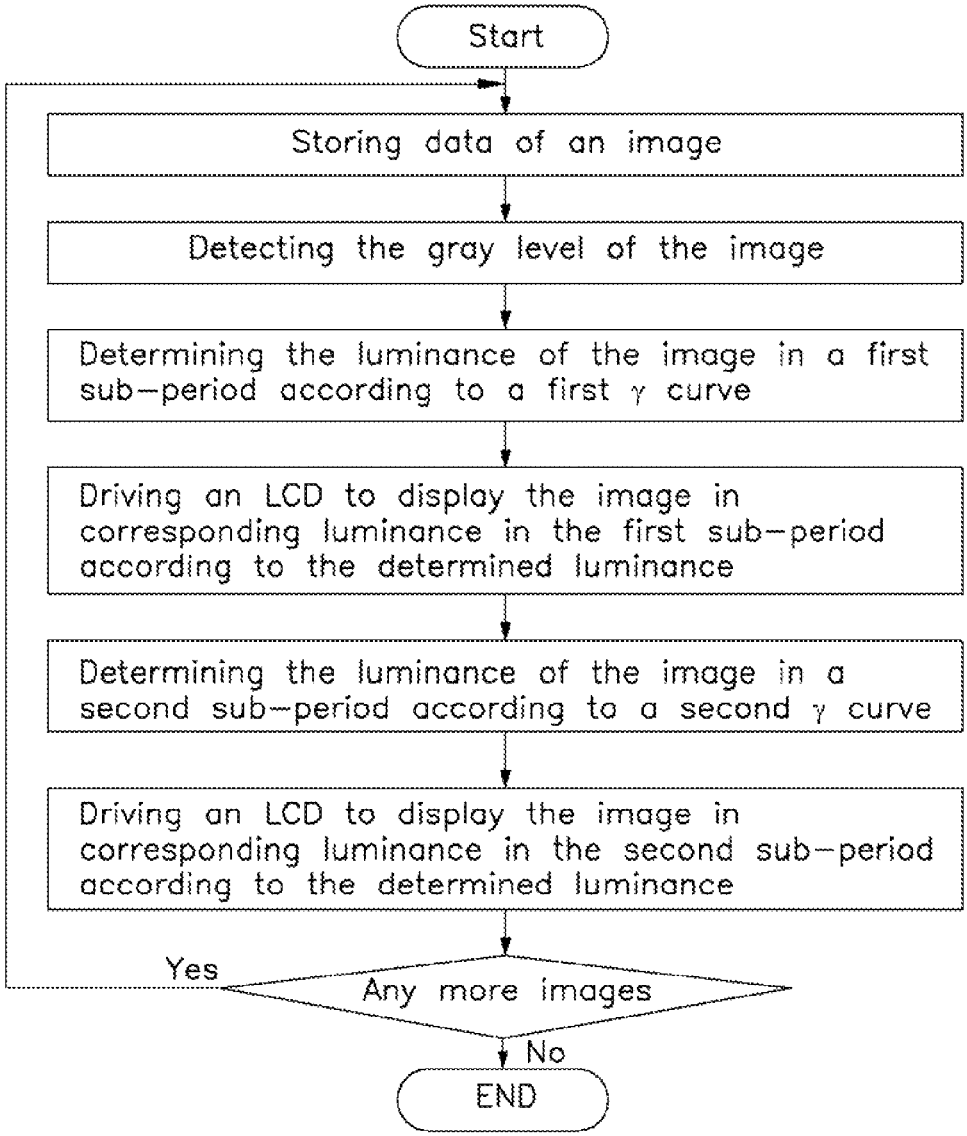
FIG. 10 is a flowchart of a gray insertion method according to a second embodiment.
Figure 11:
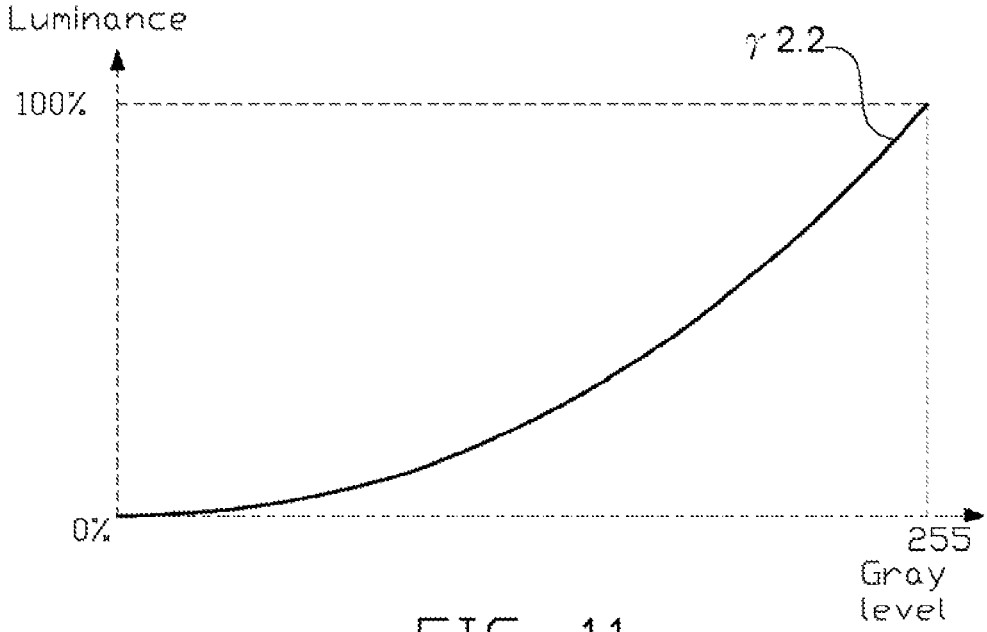
FIG. 11 (RELATED ART)
FIG. 11 is a diagram of a γ curve stored by a commonly used LCD.
Figure 12:
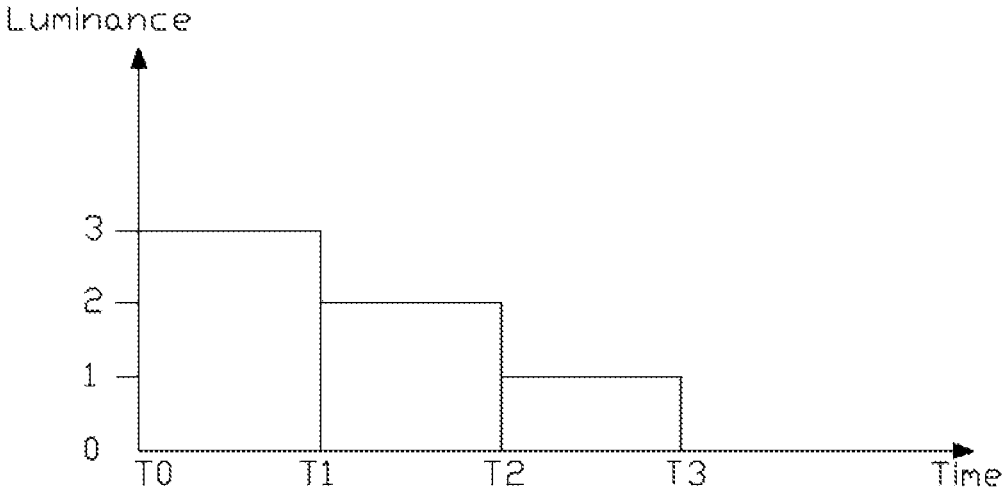
FIG. 12 (RELATED ART)
FIG. 12 is a diagram of the luminance of a pixel of the LCD storing the γ curve shown in FIG. 11 sequentially displaying its corresponding portions of a plurality of images.
Figure 13:
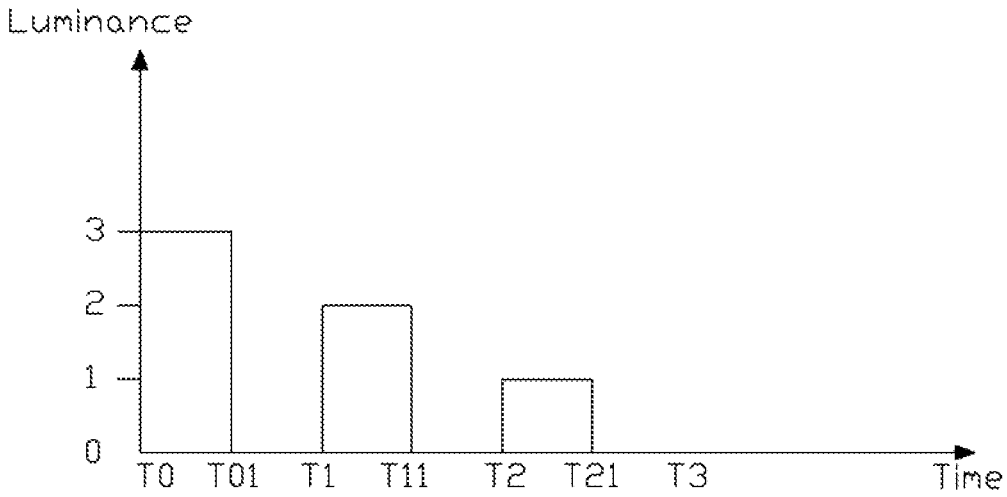
FIG. 13 (RELATED ART)
FIG. 13 is a diagram of the luminance of a pixel of an LCD storing the γ curve shown in FIG. 11 and using commonly used black insertion technology sequentially displaying its corresponding portions of a plurality of images.
Figure 14:
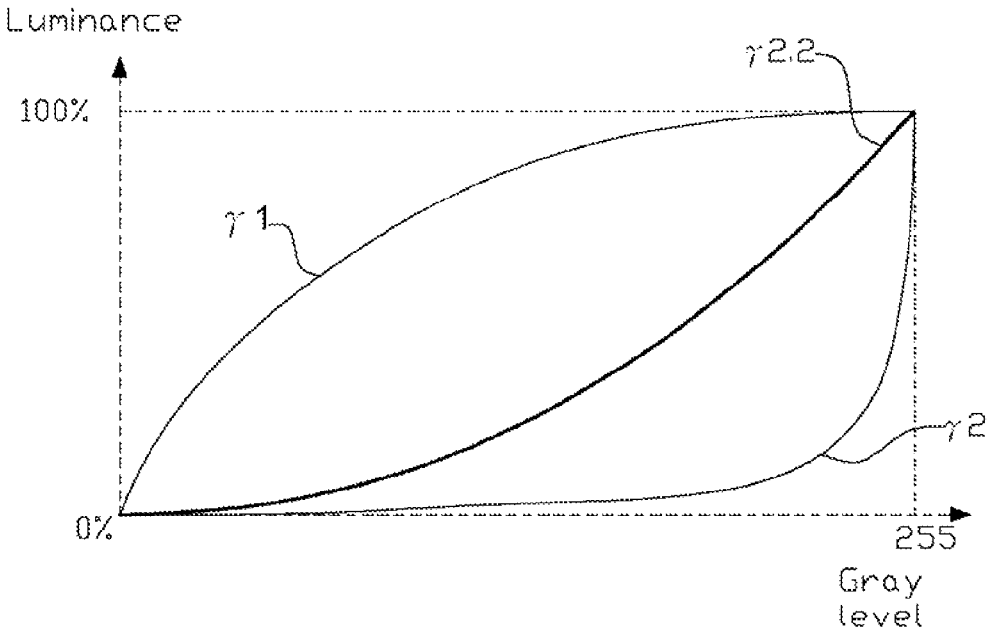
FIG. 14 (RELATED ART)
FIG. 14 is a diagram of two γ curves stored by an LCD using commonly used gray insertion technology.
Figure 15:
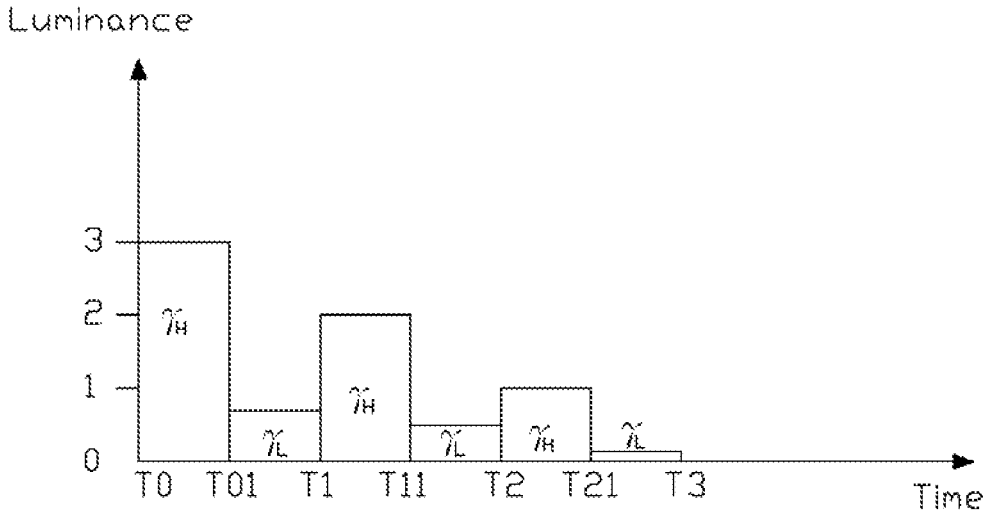
FIG. 15 (RELATED ART)
FIG. 15 is a diagram of the luminance of a pixel of the LCD storing the γ curves shown in FIG. 14 and using commonly used gray insertion technology sequentially displaying its corresponding portions of a plurality of images.

Also referring to FIG. 10, a method for using the display driving unit 20 in the LCD 10 to drive the LCD 10 display images, according to a second exemplary embodiment, is provided, as follows. Data of an image is input to the register 32 and temporarily stored therein. The stored data is transmitted to the processor 31, and the processor 31 detects the gray level of the image. The processor 31 determines the luminance of the image in the first sub-period of the display period for displaying the image according to the first γ curve $\gamma_A$ stored in the first storage unit 33. Fourth, the image data is input to the data driving circuit 22. The data driving circuit 22 cooperates with the scan driving circuit 21 to display the image on the display panel 11 in the first sub-period of the display period for displaying the image and regulate the luminance of the image according to the luminance determined by the processor 31. Fifth, the processor 31 determines the luminance of the image in the second sub-period of the display period for displaying the image according to the second γ curve $\gamma_B$ is stored in the second storage unit 34. Sixth, the image data is input to the data driving circuit 22. The data driving circuit 22 cooperates with the scan driving circuit 21 to drive the LCD 10 to display the image on the display panel 11 and regulate the luminance of the image according to the luminance determined by the processor 31. When the subsequent image is displayed, the data of the new image is stored in the register 32 and replaces the data of the previous image. Thus, the above steps can be repeated to display the next image.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A display driving unit used in a liquid crystal display having a display panel, comprising:

a scan driving circuit connected to the display panel;

a data driving circuit connected to the display panel; and a gray insertion processing unit including a processor, a register, a first storage unit, and a second storage unit; the first storage unit storing a first γ curve, the second storage unit storing a second γ curve, and both the first storage unit and the second storage unit storing a standard γ curve; the first γ curve and the second γ curve intersecting and respectively including at least one high luminance segment corresponding to luminance higher than luminance corresponding to the portion of the standard γ curve in the gray level range of the high luminance segment and at least one low luminance segment corresponding to luminance lower than luminance corresponding to the portion of the standard γ curve in the gray level range of the low luminance segment; the high luminance segments of one of the first γ curve and the second γ curve and the low luminance segments of another of the first γ curve and the second γ curve respectively corresponding to same gray level ranges;

wherein the register stores data of each image displayed by the liquid crystal display, the processor detects the gray level of the image, determines the luminance of the image in a first sub-period for displaying the image according to the gray level of the image and the first γ curve, and determines the luminance of the image in a second sub-period for displaying the image according to the gray level of the image and the second γ curve; the data driving circuit cooperates with the scan driving circuit to sequentially display the image in the luminance determined according to the gray level of the image and the first γ curve in the first sub-period and display the image in the luminance determined according to the gray level of the image and the second γ curve in the second sub-period.

2. The display driving unit as claimed in claim 1, wherein the first γ curve and the second γ curve intersect at one point of the standard γ curve.

3. The display driving unit as claimed in claim 2, wherein the high luminance segment of the first γ curve and the low luminance segment of the second γ curve correspond to a gray level range from the lowest gray level to the gray level of the intersection of the first γ curve and the second γ curve, and the low luminance segment of the first γ curve and the high luminance segment of the second γ curve correspond to a gray level range from the gray level of the intersection of the first γ curve and the second γ curve to the highest gray level.

4. The display driving unit as claimed in claim 3, wherein the liquid crystal display comprises gray levels 0-255, the high luminance segment of the first γ curve corresponding to gray levels 0-128 and including a first ascending portion and a first level portion, and the low luminance segment of the first γ curve corresponding to gray levels 128-255 and including a second level portion and a second ascending portion; the luminance corresponding to the first ascending portion and the second ascending portion gradually increasing with the gray scale, and the luminance corresponding to the first level portion and the second level portion invariable 50% of the highest luminance; the low luminance segment of the second γ curve corresponding to gray levels 0-128 and including a third level portion and a third ascending portion, and the second high luminance segment of the second γ curve corresponding to gray levels 128-255 and including a fourth ascending portion and a fourth level portion; the luminance corresponding to the third ascending portion and the fourth ascending portion gradually increasing with the gray scale, the luminance corresponding to the third level portion no luminance, and the luminance corresponding to the fourth level portion the highest luminance.

5. The display driving unit as claimed in claim 1, wherein the first γ curve and the second γ curve intersect at two points of the standard γ curve.

6. The display driving unit as claimed in claim 5, wherein the first γ curve includes two high luminance segments and a low luminance segment positioned between the two high luminance segments, and the second γ curve includes two low luminance segments and a high luminance segment positioned between the two low luminance segments.

7. The display driving unit as claimed in claim 6, wherein the liquid crystal display comprises gray levels 0-255, the two high luminance segments and the low luminance segment of the first γ curve respectively corresponding to gray levels 0-72, 128-255, and 72-128, and the two low luminance segments and the high luminance segment of the second γ curve respectively corresponding to gray levels 0-72, 128-255, and 72-128.

8. The display driving unit as claimed in claim 7, wherein the first γ curve ascends in ranges corresponding to gray levels 0-56 and 112-180 and levels in ranges corresponding to gray levels 56-112 and 180-255, the two level portions of the first γ curve respectively corresponding to 8% of the highest luminance and 100% of the highest luminance; the second γ curve levels in ranges corresponding to gray levels 0-56 and 112-180 and ascends in ranges corresponding to gray levels 56-112 and 180-255, the two level portions of the second γ curve respectively corresponding to no luminance and 25% of the highest luminance.

9. A method for using a display driving unit in an liquid crystal display to drive the liquid crystal display to display an image, comprising:

storing a standard γ curve, a first γ curve and a second γ curve in the display driving unit, the first γ curve and the second γ curve intersecting and respectively including at least one high luminance segment corresponding to luminance higher than luminance corresponding to the portion of the standard γ curve in the gray level range of the high luminance segment and at least one low luminance segment corresponding to luminance lower than luminance corresponding to the portion of the standard γ curve in the gray level range of the low luminance segment; the high luminance segments of one of the first γ curve and the second γ curve and the low luminance segments of another of the first γ curve and the second γ curve corresponding to same gray level ranges;

inputting data of the image to the display driving unit;

using the display driving unit to detect the gray level of the image;

using the display driving unit to determine the luminance of the image in a first sub-period for displaying the image according to the first γ curve, and determine the luminance of the image in a second sub-period for displaying the image according to the second γ curve; and using the display driving unit to drive the liquid crystal display to sequentially display the image in the luminance determined according to the gray level of the image and the first γ curve in the first sub-period and display the image in the luminance determined according to the gray level of the image and the second γ curve in the second sub-period.

10. The method as claimed in claim 9, wherein the image is displayed in the luminance gradually increasing with the gray level in one sub-period and displayed in no luminance in another sub-period when the image is in a relatively low gray level, the image is displayed in the luminance gradually increasing with the gray level in one sub-period and displayed in predetermined luminance in another sub-period when the image is in a medium gray level, and the image is displayed in the luminance gradually increasing with the gray level in one sub-period and displayed in the highest luminance of the liquid crystal display in another sub-period when the image is in a relatively high gray level.

11. A method for using a display driving unit in an liquid crystal display to drive the liquid crystal display to display an image, comprising:

storing a standard γ curve, a first γ curve and a second γ curve in the display driving unit, the first γ curve and the second γ curve intersecting and respectively including at least one high luminance segment corresponding to luminance higher than luminance corresponding to the portion of the standard γ curve in the gray level range of the high luminance segment and at least one low luminance segment corresponding to luminance lower than luminance corresponding to the portion of the standard γ curve in the gray level range of the low luminance segment; the high luminance segments of one of the first γ curve and the second γ curve and the low luminance segments of another of the first γ curve and the second γ curve corresponding to same gray level ranges;

inputting data of the image to the display driving unit;

using the display driving unit to detect the gray level of the image;

using the display driving unit to determine the luminance of the image in a first sub-period for displaying the image according to the first γ curve;

using the display driving unit to drive the liquid crystal display to display the image in the luminance determined according to the gray level of the image and the first γ curve in the first sub-period;

using the display driving unit to determine the luminance of the image in a second sub-period for displaying the image according to the second γ curve; and using the display driving unit to drive the liquid crystal display to display the image in the luminance determined according to the gray level of the image and the second γ curve in the second sub-period.

12. The method as claimed in claim 11, wherein the image is displayed in the luminance gradually increasing with the gray level in one sub-period and displayed in no luminance in another sub-period when the image is in a relatively low gray level, the image is displayed in the luminance gradually increasing with the gray level in one sub-period and displayed in predetermined luminance in another sub-period when the image is in a medium gray level, and the image is displayed in the luminance gradually increasing with the gray level in one sub-period and displayed in the highest luminance of the liquid crystal display in another sub-period when the image is in a relatively high gray level.

* * * * *